US007865973B1

(12) United States Patent
Gibson

(10) Patent No.: US 7,865,973 B1
(45) Date of Patent: Jan. 11, 2011

(54) ADJUSTABLE HOSPITAL GOWN

(76) Inventor: Sam Gibson, 320 McCullough, Sharpsville, PA (US) 16150

( * ) Notice: Subject to any disclaimer, the term of this patent is extended or adjusted under 35 U.S.C. 154(b) by 307 days.

(21) Appl. No.: 12/286,851

(22) Filed: Oct. 2, 2008

(51) Int. Cl.
*A41D 13/12* (2006.01)

(52) U.S. Cl. ..... 2/114; 2/51

(58) Field of Classification Search ..... 2/114, 2/48, 51, 52, 338, 46, 47, 49.1–49.5, 50, 2/92, 247, 249, 69, 88, 93, 94; 224/660, 224/663–665, 576, 577, 586
See application file for complete search history.

(56) References Cited

U.S. PATENT DOCUMENTS

| | | | | | |
|---|---|---|---|---|---|
| 1,136,732 | A * | 4/1915 | Steiner et al. | 2/51 |
| 1,474,415 | A * | 11/1923 | Glassbrenner | 2/48 |
| 2,532,499 | A * | 12/1950 | Jackson et al. | 2/52 |
| 2,580,388 | A * | 1/1952 | Allen | 2/49.1 |
| 3,161,887 | A * | 12/1964 | Silver | 2/88 |
| 3,561,446 | A * | 2/1971 | Jones, Sr. | 604/385.201 |
| 3,594,818 | A * | 7/1971 | Planner | 2/114 |
| 3,720,957 | A * | 3/1973 | Patience | 2/114 |
| 4,040,124 | A | 8/1977 | Zoephel | |
| 4,190,905 | A * | 3/1980 | Reverberi | 2/1 |
| 4,426,740 | A * | 1/1984 | Reverberi | 2/84 |
| 4,459,703 | A * | 7/1984 | Kosmas et al. | 2/48 |
| 4,698,854 | A * | 10/1987 | Slimmon | 2/338 |
| 5,003,634 | A * | 4/1991 | Brinkman | 2/46 |
| 5,097,534 | A | 3/1992 | Viemeister et al. | |
| 5,361,414 | A | 11/1994 | Smith | |
| 5,564,125 | A * | 10/1996 | Waldman et al. | 2/93 |
| 5,768,707 | A | 6/1998 | Lederer | |
| 5,960,472 | A * | 10/1999 | Reid | 2/48 |
| 6,694,522 | B1 | 2/2004 | Neal | |
| 6,715,160 | B2 * | 4/2004 | Crye et al. | 2/457 |
| 7,039,956 | B1 * | 5/2006 | Hsia | 2/49.1 |
| 7,234,171 | B2 * | 6/2007 | Rowe et al. | 2/114 |
| 2008/0271222 | A1 * | 11/2008 | Nienow | 2/88 |

* cited by examiner

*Primary Examiner*—Amy B Vanatta
(74) *Attorney, Agent, or Firm*—Harpman & Harpman

(57) ABSTRACT

A self-contained expandable hospital gown having a central retainment belt from which expandable adjustable upper and lower gown portions can be selectively deployed. Engagement and interlocking tabs provide deployment on the upper torso extending portion and a lower torso extending portion with independent retainment and positioning access openings associated therewith.

7 Claims, 4 Drawing Sheets

ADJUSTABLE HOSPITAL GOWN

BACKGROUND OF THE INVENTION

1. Technical Field

This invention relates to hospital gowns that are used to cover patients in hospital and medical practice venues that require a simple universal garment for the patient to wear for examinations and procedures.

2. Description of Prior Art

Prior art garments of this type are typically cloth with modified sleeves and a series of fabric fastener strip extending therefrom. Such gowns are characterized by having an open back which allows for ease of placement and removal. Other such gowns are of a disposable type made of paper and are used more often in doctor offices for exams or for testing purposes. Such paper gowns are less body conforming than cloth and of a quality for a one time temporary use.

Examples of prior art gowns can be seen in U.S. Pat. Nos. 4,040,124, 5,097,534, 5,361,414, 5,768,707 and 6,694,522.

In U.S. Pat. No. 4,040,124 a hospital gown with fitting means is disclosed in which a gown garment is provided with an adjustable belt band that encircles the wearer's body about the waist with a cohesive adhesive adjustable attachment material positioned thereon.

U.S. Pat. No. 5,097,534 discloses a protective garment folded up in a compact configuration which can be used unfolded displaying a garment with arms, legs and a hood portion.

U.S. Pat. No. 5,361,414 claims a hospital privacy gown having a front portion with a split open rear portion divided into two segments that are retained together by fastener type elements. A cover-up component is provided to assure personal modesty.

An examination gown is shown in U.S. Pat. No. 5,768,707 formed of multiple fabric panels seamed together so that two upper body panels are joined with four lower body panels defining multiple access slits in front and back for ease of examination access.

U.S. Pat. No. 6,694,522 discloses a universal hospital gown with an overlapping vertical rear opening having multiple interlocking spaced fastener segments of hook and loop material which allow for size adjustment depending on height and weight of the patient.

SUMMARY OF THE INVENTION

An expandable self-contained deployable hospital gown having a central adjustable deployment belt from which upper body portion and a lower body portion can be selectively pulled therefrom. Fastening surface adjustably inner engage adjacent gown portions to define the expandable tubular upper and lower gown body portions. Elastic insert assures upper portion retention under the arms of the patient with an integral examination hinged flap opening allowing for quick access to the patient's body.

DETAILED DESCRIPTION OF THE INVENTION

Figure 1:
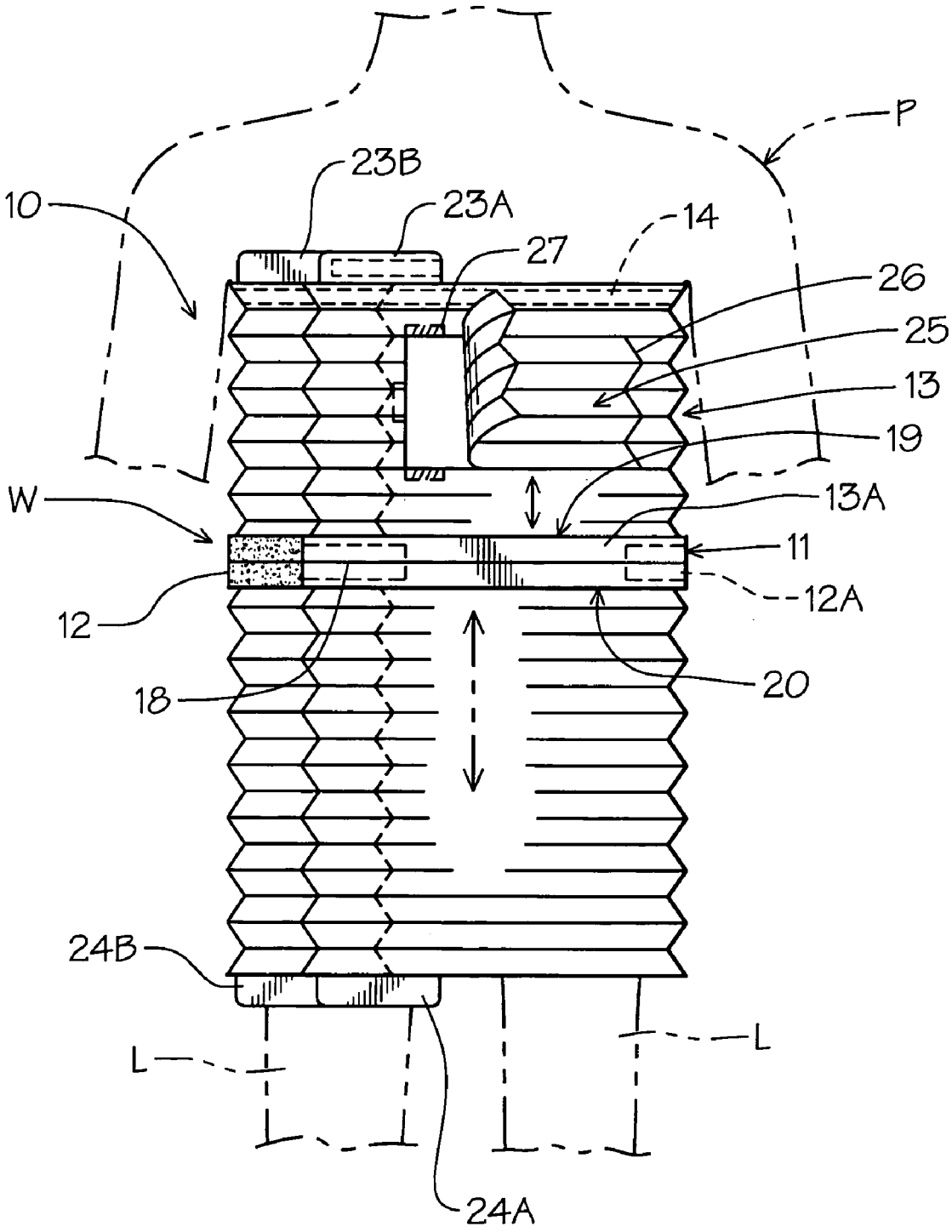
FIG. 1 is a front elevational view of the new gown of the invention in deployed use position.
Figure 2:
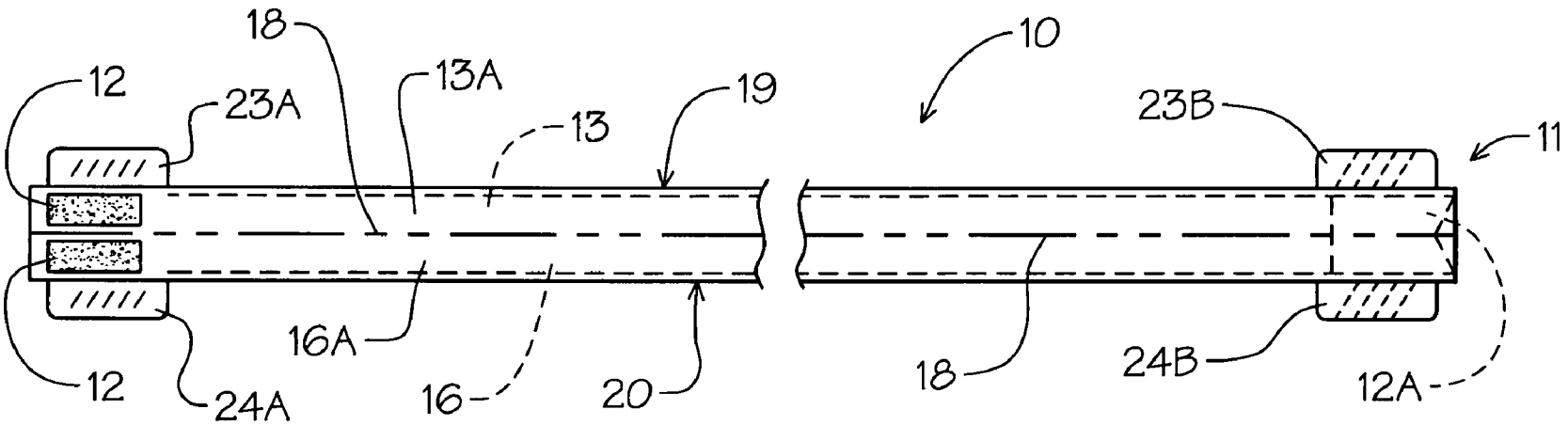
FIG. 2 is a front elevational view of the gown of the invention with portions broken away in non-deployed position.

Referring to FIGS. 1 and 2 of the drawings an expandable disposable hospital gown 10 of the invention can be seen in extended deployed use position on a patient P. The gown 10 has a dual compartment storage belt 11 with oppositely disposed end fastener surfaces 12 and 12A extending inwardly therefrom. This will allow for user adjustment about the waist W of the patient P illustrated in broken lines by overlapping the respective end thereof and associated fastener surfaces.

An upper torso portion 13 extends from an upper elongated compartment 13A of the storage belt 11 in a folded expandable bellows fashion. An integrated elastic band 14 is secured within and along its upper perimeter free edge 15 so as to apply elastic retainment when secured to its oppositely disposed end surface. Conversely, lower body and leg cover portion 16 is foldably deployed from an elongated lower compartment 16A of the storage belt 11 so as to be extended down around the patient's P legs L shown in broken lines in FIG. 1 of the drawings.

Figure 3:
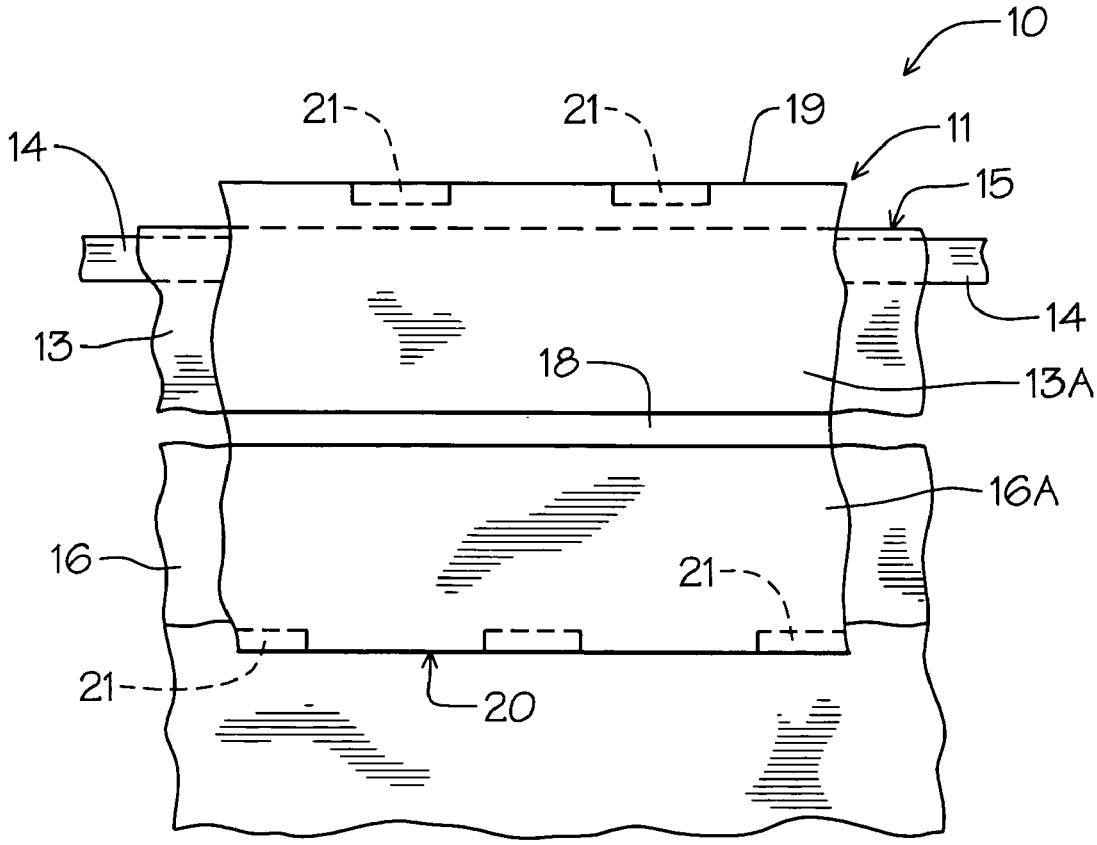
FIG. 3 is an enlarged front elevational view in partial deployment with portions broken away.
Figure 4:
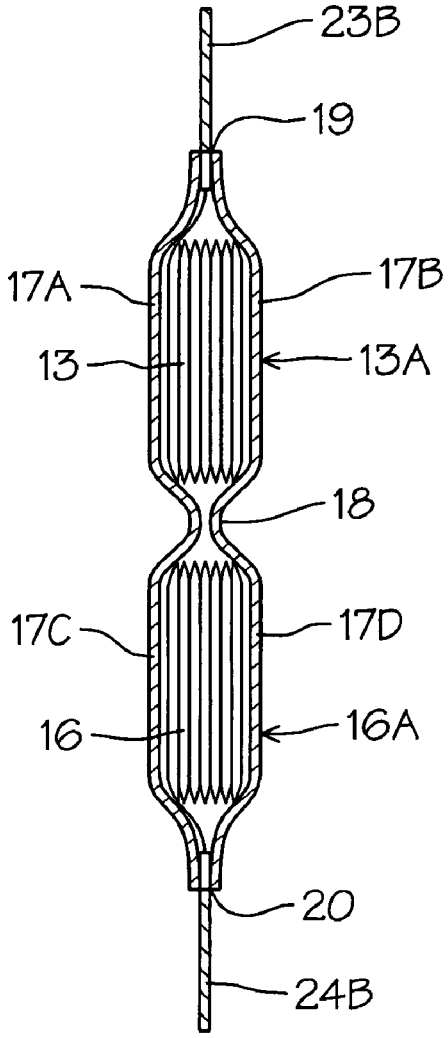
FIG. 4 is an enlarged partial sectional view of the belt storage compartment of the invention.
Figure 5:
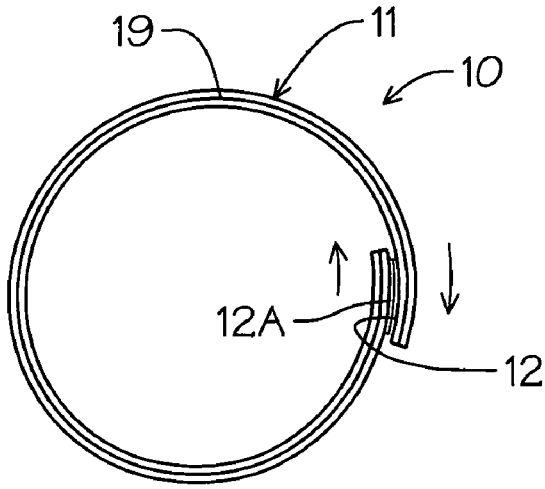
FIG. 5 is a top plan graphic representation of the deployment belt in adjustable use position.

Referring now to FIGS. 3 and 4 of the drawings, the dual storage compartments 13A and 16A are formed from inner and outer flexible wall portions 17A, 17B and 17C, 17D respectively joined together centrally at 18 in this example defining oppositely disposed elongated deployment openings at 19 and 20.

Selective retainment fastener surfaces 21 of cohesive adhesive coating along the respective free perimeter edges thereof temporarily close and retain the respective bi-folded upper and lower cover portions 13 and 17 therewithin until deployment.

Pairs of engagement and deployment tabs 23A, 23B and 24A, 24B extend along and from the respective end edge surfaces of the cover portions 13 and 17 outwardly from the compartments of the storage belt allowing for user deployment of the respective bi-fold cover portions 13 and 17 once the storage belt 11 is adjustably secured about the user's waist as hereinbefore described.

Due to the overlapping relationship of the respective upper and lower edges and co-adhesion of the deployment tabs 23A, 23B and 24A, 24B, the gown 10 of the invention, once deployed, provides a secure comfortable modesty cover for both the upper and lower portions of the patient's body.

Referring now back to FIG. 1 of the drawings, an exam access panel 25 is provided in the upper torso cover portion 13 with a live hinge 26 and selective fastener surfaces 27 therealong allowing simple easy exam access to the patients by healthcare professionals.

Referring now to FIG. 4 of the drawings, a modified sectional view of the storage compartments 13A and 17A can be seen wherein the respective upper expandable torso cover 13 and lower body cover 17 are bi-folded within the respective storage compartments. The storage belt 11, covers 13 and 17 are preferably made of disposable paper products prefolded and fabricated in the above disclosed novel configuration.

It will thus be seen that a new and novel disposable, deployable, compact hospital gown 10 of the invention has been illustrated and described and it will be apparent to those skilled in the art that various changes and modification may be made thereto without departing from the spirit of the invention. Therefore I claim:

The invention claimed is:

1. A hospital exam gown for patients comprising, an adjustable deployment belt having an integral storage chamber therewithin, an upper extending body cover portion within said storage chamber, a lower extending body cover portion within said storage chamber, multiple user engagement deployment elements on said upper and lower extending body cover portions, means for adjustably securing said belt around said patient, an elastic retaining element in said upper body cover in spaced relation to said storage chamber and cohesive adhesive surfaces on said multiple engagement elements for interengagement therebetween.

2. The hospital gown of claim 1 wherein said integral storage chamber defines, respective oppositely disposed deployment openings therewithin.

3. The hospital gown of claim 1 wherein said respective upper and lower body cover portions are bi-folded for storage and incremental deployment from within said respective storage chambers.

4. The hospital gown set forth in claim 1 wherein said multiple user engagement deployment elements comprise, tabs extending from respective surfaces.

5. The hospital gown set forth in claim 1 wherein said means for adjustably securing said belt on said patient comprises, fastener engagement areas on oppositely disposed belt ends on opposite side surfaces for overlapping engagement with one another.

6. The hospital gown set forth in claim 1 wherein said upper body cover has an access exam opening with integral closure flaps selectively engaged thereover.

7. The hospital gown set forth in claim 2 wherein said respective deployment openings in said storage chambers have cohesive adhesive perimeter edge surfaces therealong for temporary closure therebetween.

* * * * *